US006006473A

United States Patent [19]

Mariel et al.

[11] Patent Number: 6,006,473

[45] Date of Patent: Dec. 28, 1999

[54] TAPE DRIVE WINDOW REGULATOR WITH UNIVERSAL HOUSING FOR ACCOMMODATING BOTH MANUAL AND ELECTRIC DRIVE MECHANISMS

[75] Inventors: James G. Mariel, Goshen; Michael D. Kobrehel, Elkhart, both of Ind.; Larry B. Walker, Crossville, Tenn.

[73] Assignee: Atwood Industries, Inc., Rochester Hills, Mich.

[21] Appl. No.: 09/042,813

[22] Filed: Mar. 17, 1998

[51] Int. Cl.[6] ..... E05F 15/00; E05F 11/48; E05F 11/38

[52] U.S. Cl. ..... 49/139; 49/140; 49/352; 49/348; 49/349

[58] Field of Search ..... 49/352, 139, 140, 49/349, 348

[56] References Cited

U.S. PATENT DOCUMENTS

| | | | |
|---|---|---|---|
| 4,004,371 | 1/1977 | Podolan et al. . | |
| 4,168,595 | 9/1979 | Pickles et al. . | |
| 4,174,865 | 11/1979 | Doveinis . | |
| 4,182,078 | 1/1980 | Bartholomew . | |
| 4,222,202 | 9/1980 | Pigeon . | |
| 4,253,277 | 3/1981 | Campbell et al. . | |
| 4,263,748 | 4/1981 | Kazewych . | |
| 4,335,541 | 6/1982 | Kazewych | 49/360 |
| 4,364,202 | 12/1982 | Zavatkay | 49/352 |
| 4,592,245 | 6/1986 | Pickles | 74/89.21 |
| 4,672,771 | 6/1987 | Lam et al. . | |
| 4,693,127 | 9/1987 | Alty | 74/25 |
| 4,793,099 | 12/1988 | Friese et al. | 49/380 |
| 4,890,376 | 1/1990 | Boileau | 29/434 |
| 5,022,184 | 6/1991 | Yamamura et al. | 49/352 |
| 5,076,014 | 12/1991 | Cuyl | 49/140 |
| 5,309,678 | 5/1994 | Adachi | 49/352 |
| 5,398,449 | 3/1995 | Kobrehel et al. . | |
| 5,493,813 | 2/1996 | Vetter et al. | 49/341 |
| 5,505,022 | 4/1996 | Shibata et al. | 49/352 |
| 5,799,441 | 9/1998 | Shibata | 49/352 |
| 5,809,696 | 9/1998 | Watanabe | 49/360 |

*Primary Examiner*—Daniel P. Stodola
*Assistant Examiner*—Gregory J. Strimbu
*Attorney, Agent, or Firm*—Banner & Witcoff, Ltd.

[57] ABSTRACT

A window regulator comprises a rail defining a central channel which receives an elongate flexible plastic tape having a plurality of slots, the width of the tape being sized to fit within the central channel, a drive mechanism for moving the tape, either electric or manual, and a universal housing connecting the rail and the drive mechanism. The universal housing can be used with either manual or electric window regulator designs. The universal housing has a central cavity which can receive an insert bracket for a manual drive drum when the drive mechanism includes a hand crank. The central cavity is sized to receive a larger, electric drive drum when the drive mechanism includes an electric motor. Either drive drum has teeth sized to engage the slots of the tape so that the drive mechanism can impart motion to the tape to raise and lower a windowpane. When the insert bracket is used, the tape is routed in the universal housing from a first slot, around the manual drive drum to a second slot. When the insert bracket is not used, the tape is routed from the first slot, around the electric drive drum to a third slot separated from the second slot.

10 Claims, 6 Drawing Sheets

TAPE DRIVE WINDOW REGULATOR WITH UNIVERSAL HOUSING FOR ACCOMMODATING BOTH MANUAL AND ELECTRIC DRIVE MECHANISMS

FIELD OF THE INVENTION

The present invention generally relates to an improved tape drive window regulator, particularly useful for motor vehicles and the like.

BACKGROUND OF THE INVENTION

Tape drive window regulators for controlling the motion of a windowpane were developed for automotive applications in the 1970s as a low-cost alternative to conventional window regulators. Typically a tape drive window regulator has a drive member such as a hand crank or a motor attached to an inner panel of a motor vehicle door, a housing for the drive member, and a flexible plastic tape connecting the drive member to the windowpane, with the tape being guided by a rail. A drive drum is directly connected to the drive member, and has circumferentially spaced teeth. The tape has slots which receive teeth of the drive drum. The drive member rotates the drive drum which, in turn, moves the tape to pull or push the windowpane up and down between a full up position and a full down position in a door.

While these designs work well, a problem has existed in connection with using a tape drive window regulator assembly for alternative manual and electric designs. Many motor vehicles are produced and sold with the option of either a manual regulator or a "power" option. Unfortunately, however, manually driven systems and motor driven systems have requirements and specifications which differ from each other. A manually driven window regulator normally includes a hand crank connected to the regulator by a spindle, clutch cup and spring. Automobile makers (sometimes referred to as Original Equipment Manufacturers or OEMs) require a hand crank to completely raise the windowpane from the full down position to the full up position in no more than a certain number of revolutions, typically about 4.5 revolutions. OEMs also restrict the amount of effort required of an operator to operate the hand crank. As the force to operate a manual window regulator is in part a function of the size of the drive drum, this restricts the maximum permissible size of the manual drive drum. For electric motor driven window regulators, in contrast, OEM requirements are directed toward a limitation of the time it takes to raise a windowpane to the full up position from the full down position. This restriction limits the size of the electric drive drum to a range which unfortunately may not overlap the size range for drive drums on manual window regulators. Consequently, two different tape drive regulator designs have been needed for the same vehicle, one for electric, and one for manual. With the ever-present pressure to reduce costs, it would be desirable to commonize the parts of a tape drive window regulator to the greatest extent possible, while still satisfying the OEM's competing design requirements for manual and electric design variations.

In view of the foregoing, it is an object of the present invention to provide a window regulator with reduced cost, complexity and enhanced manufacturability. It is yet another related object of the present invention to provide a tape drive window regulator having a design which readily accommodates alternative manual drive and electric drive assemblies meeting their respective OEM requirements. It is an additional object of the present invention to provide a window regulator that is highly reliable in operation.

SUMMARY OF THE INVENTION

In accordance with these and other objects, there is provided a window regulator for raising and lowering a windowpane in a motor vehicle door, comprising a rail defining a central channel, an elongate flexible plastic tape having a plurality of slots longitudinally spaced along the length of the tape, with a portion of the tape positioned in the central channel, a drive member such as a hand crank or electric motor for moving the tape, a universal housing connecting the rail and the drive member, the universal housing preferably being adapted for mounting to an inner panel of a motor vehicle, the universal housing having a central cavity which receives the drive member, a first slot extending from the central cavity toward the central channel of the rail, and second and third slots extending from the central cavity. The tape is routed from the central channel of the rail through the first slot to the central cavity, and from there to either the second slot or the third slot, depending on whether the drive member is a hand crank or a motor, i.e., whether the regulator is manual or electric.

When the tape drive is installed, the tape is attached typically to a glider slidably mounted on the rail and engaged with the windowpane to be controlled. In operation, a drive drum is rotatable by the drive member, and has a series of teeth circumferentially spaced around the drum which project into the slots in the tape so that rotation of the drive drum imparts motion to the tape. The drive drum is rotated and this in turn moves the windowpane up or down. When an electric motor is used as the drive member, the drum is sized to route the tape through the above-mentioned third slot of the universal housing. When a manual hand crank is used, for electric to manual conversion insert bracket is inserted into the central cavity. In this way the size of the central cavity is adjusted to receive the smaller drive drum used in the manual drive alternative. The insert bracket has a first portion positioned in the central cavity and a second portion positioned in the third slot, blocking the third slot. A manual drive drum routes the tape toward the second slot. Thus, the only essential differences between the manual version of the tape drive window regulator and the electric version of the tape drive window regulator are the selection of drive members and the drive drum, and the use of an insert bracket on the manual design. This advantageously allows the present invention to significantly reduce the number of parts by commonizing the housing design.

From the foregoing disclosure and the following more detailed description of various preferred embodiments it will be apparent to those skilled in the art that the present invention provides a significant advance in the technology and art of tape drive window regulators. Particularly significant in this regard is the potential the invention affords for commonization of parts, for enhanced manufacturability and reliability, and for low cost. Additional features and advantages of various preferred embodiments will be better understood in view of the detailed description provided below.

Figure 1:
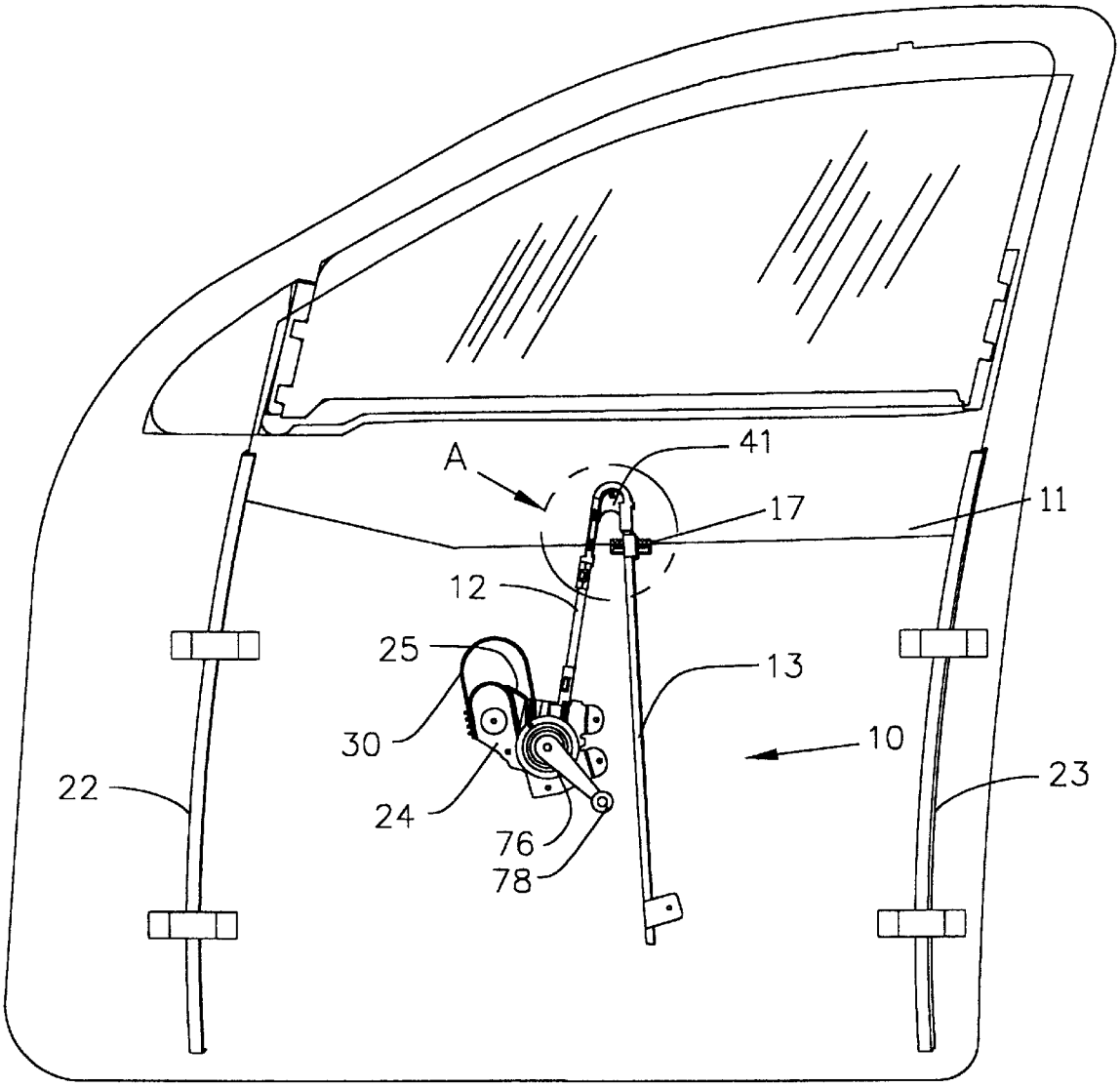
FIG. 1 is a side view of a window regulator showing a preferred embodiment using a tape drive and a manual hand crank to drive a windowpane between a full up and a full down position.

It should be understood that the appended drawings are not necessarily to scale, presenting a somewhat simplified representation of various preferred features illustrative of the basic principles of the invention. The specific design features of a tape drive window regulator as disclosed here, including, for example, the specific dimensions of the electric-to-manual insert bracket, will be determined in part by the particular intended application and use environment. Certain features of the illustrated embodiments have been enlarged or distorted relative to others to facilitate visualization and clear understanding. In particular, thin features may be thickened, for clarity of illustration. All references to direction and position, unless otherwise indicated, refer to the orientation of the tape drive window regulator illustrated in the drawings. In general, forward and rearward refer to left and right directions, respectively, in the plane of the paper in the side view of FIG. 1, and up, down or vertical refers to corresponding directions in the plane of the paper in FIG. 1.

DETAILED DESCRIPTION OF CERTAIN PREFERRED EMBODIMENTS

It will be apparent to those skilled in the art, that is, to those who have knowledge or experience in this area of technology, that many design variations are possible for the tape drive window regulator disclosed herein. The following detailed discussion of various alternative and preferred features and embodiments will illustrate the general principles of the invention with reference to a tape drive window regulator used to control the motion of a windowpane in a motor vehicle door, although the principles of the invention will be applicable to windowpanes used elsewhere.

Figure 2:
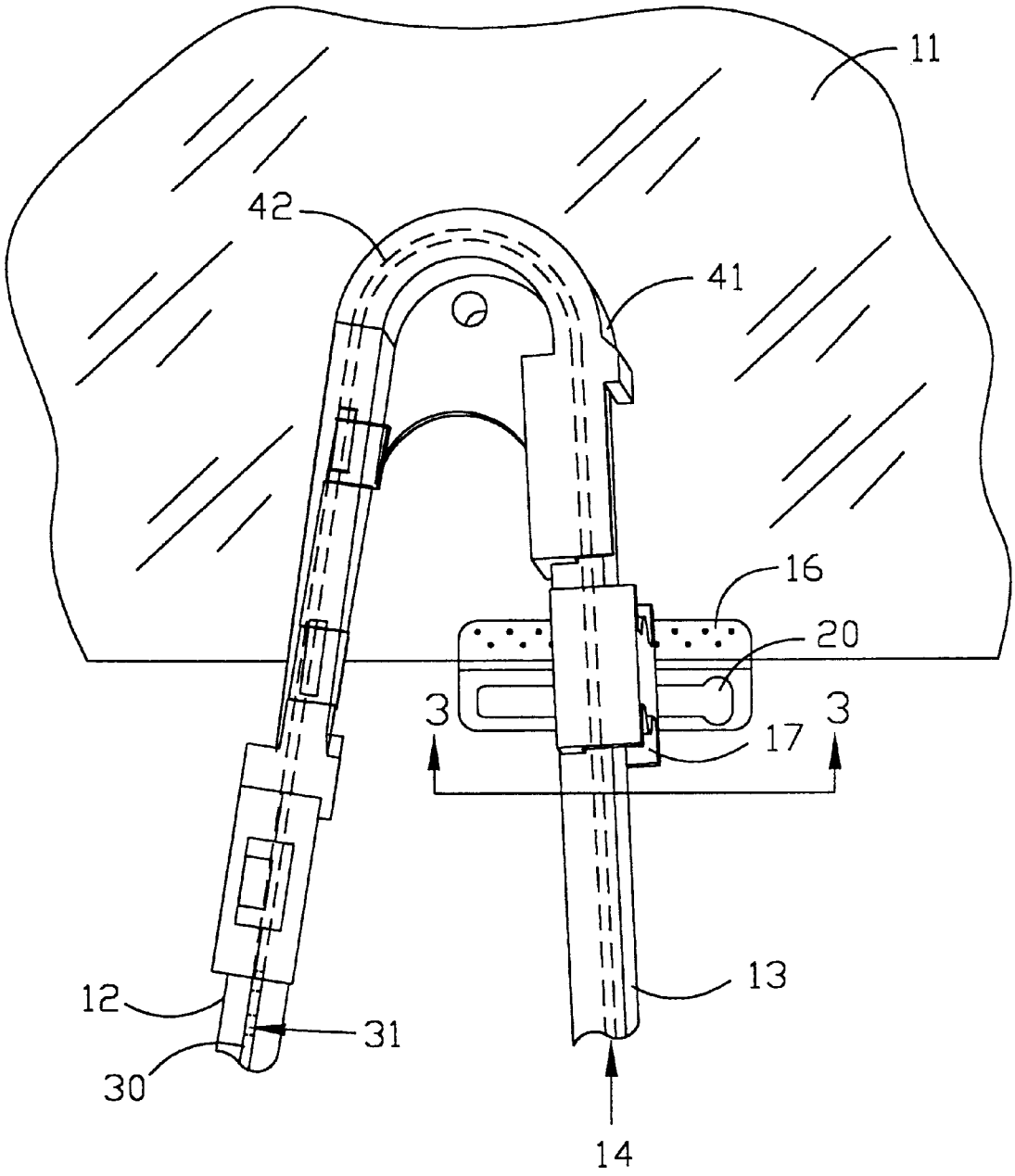
FIG. 2 is a close-up view of area A in FIG. 1, focusing on the apex bracket connecting the rails.

Referring now to the drawings, FIG. 1 shows a motor vehicle door having a windowpane 11 near a full up position. The windowpane 11 travels in a substantially vertical direction between run channels 22, 23, and is controlled by a tape drive window regulator 10 mounted to an inner panel (not shown) of the door. The tape drive regulator 10 comprises an elongate flexible plastic tape 30 provided with a plurality of slots 31 evenly spaced along the length of the tape. The tape 30 acts as a force transmitting device, transmitting rotary motion from a drive member to provide up and down motion of the windowpane 11. In the preferred embodiments shown in the drawings, the tape 30 is routed through a first rail 12 to an apex bracket 41, and then on to a second rail 13. As seen in FIG. 2, preferably the tape 30 is routed through the central channel 14 in the first rail 12 to the slot 42 in the apex bracket 41 which bends the tape at an angle back to a central channel 14 of the second rail. Size constraints within the motor vehicle door and varying windowpane sizes may require slots forming more or less acute apex bracket angles. Advantageously a family of different motor vehicles can use different apex brackets while the rails 12, 13 remain the same.

Figure 3:
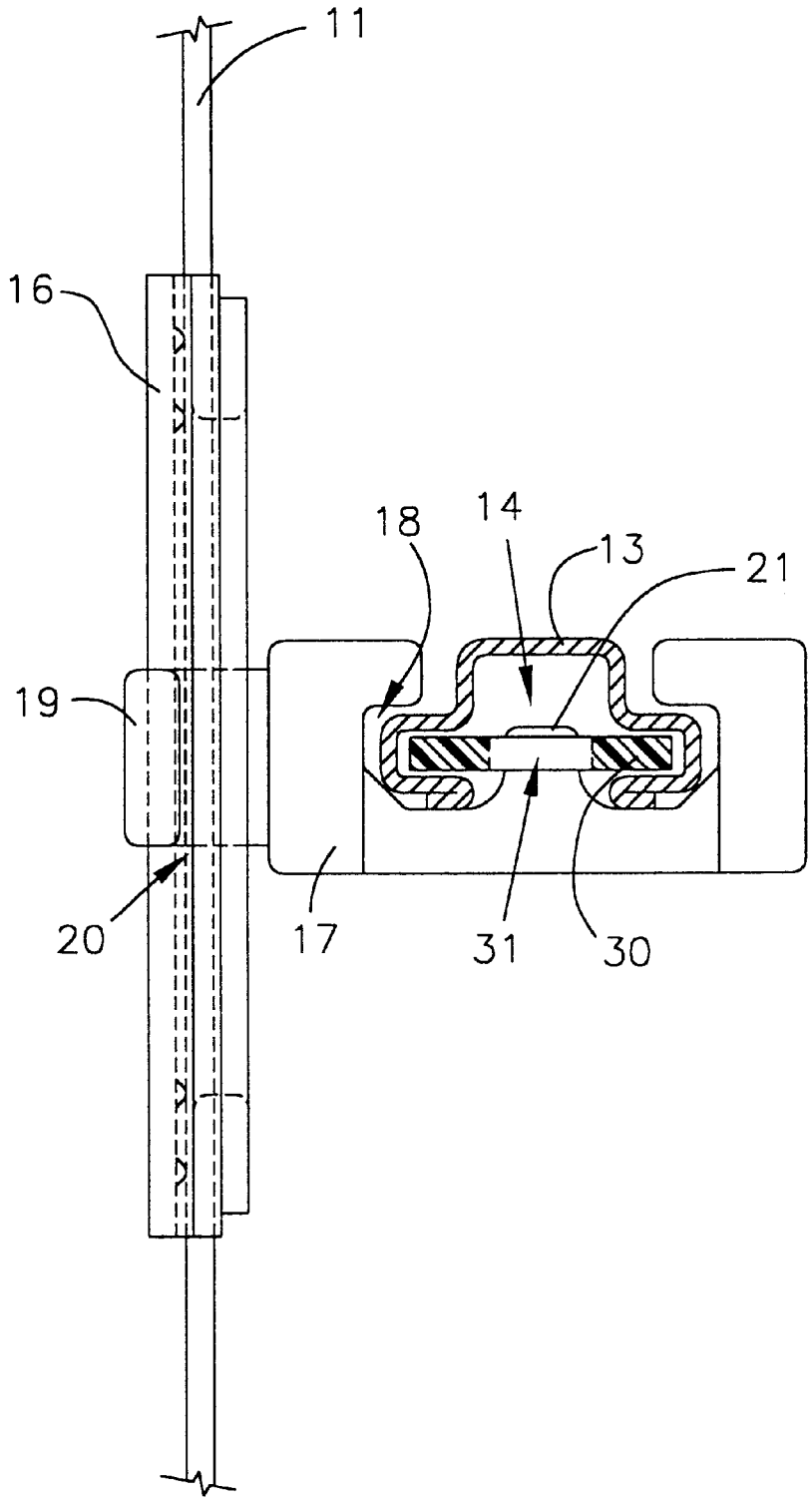
FIG. 3 is a cross section view of the glider taken through line 3—3 in FIG. 1, showing the connection between the tape drive and the glider.

FIG. 3 shows a glider 17 having a glider slot 18 shaped so as to slidably receive the rail 13. The glider is attached to the tape 30 by glider teeth 21 which extend into the central channel 14 of rail 13 and fit into the tape drive slots 31. The glider 17 is also attached to the windowpane 11 via attachment bracket 16, so that motion of the tape is transmitted through the glider to raise and lower the windowpane. The windowpane attachment bracket 16 is preferably attached at or near a bottom edge of the windowpane 11 by adhesive bonding, bolts through the glass or other suitable attachment means. The attachment bracket 16 is provided with a slot 20. Slot 20 receives glider projection or engagement flange 19 extending from one side of the glider 17. Preferably the slot 20 has a length (i.e., a longitudinal fore and aft spacing) which allows for some lateral or fore and aft motion of the windowpane with respect to the tape drive window regulator 10 which is fixed to the motor vehicle door. The glider projection 19 is aligned generally parallel to the bottom edge of the windowpane 11.

Figure 4:
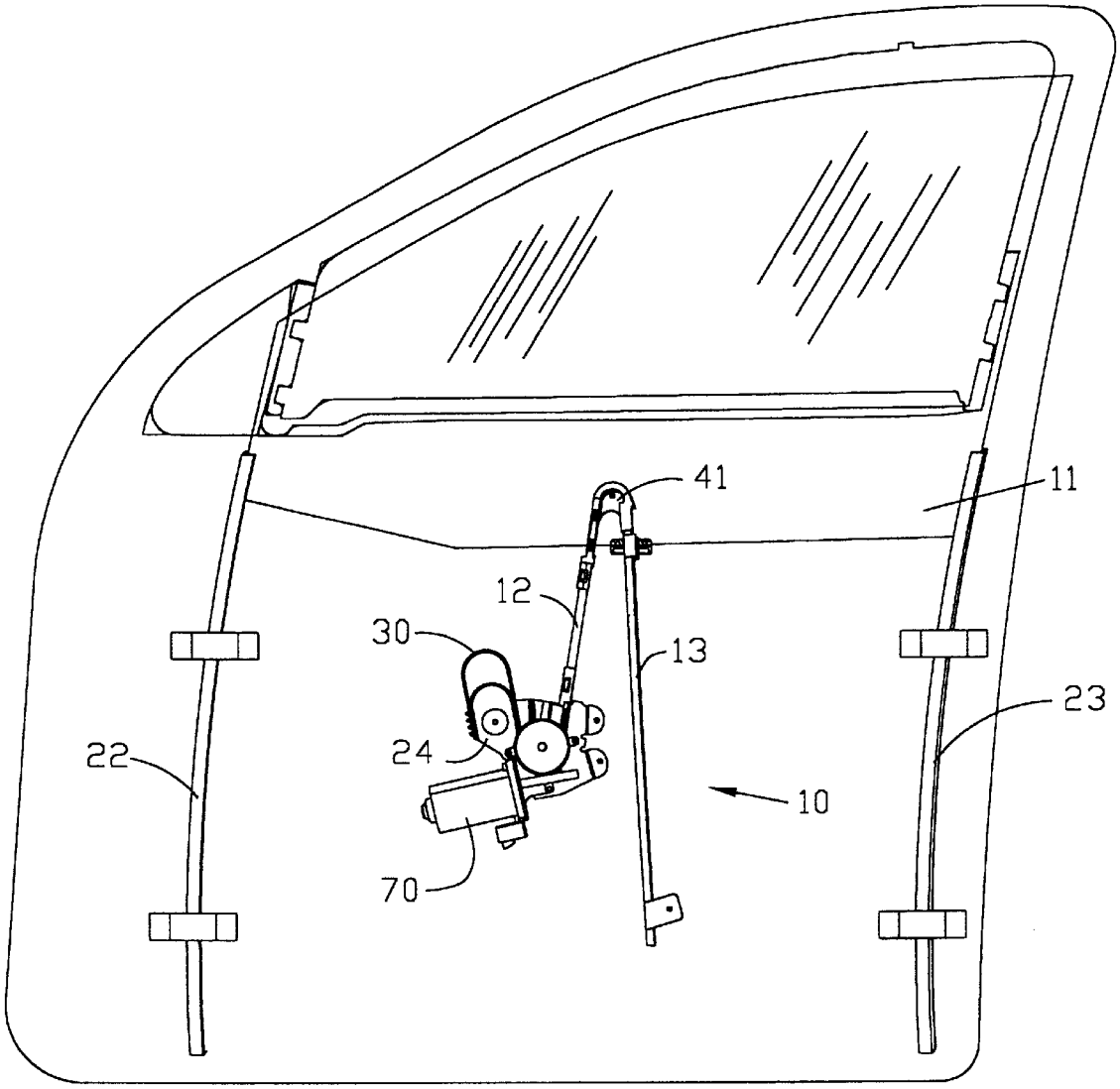
FIG. 4 is a side view of a window regulator, showing an electrically driven, alternative preferred embodiment.

FIG. 4 shows an alternative preferred embodiment of a window regulator 10 using a tape 30 wherein the driving force is provided by an electric motor 70. A universal housing 24 is advantageously usable for both manual and electric embodiments, and is shown in greater detail in FIG. 5, discussed below.

Figure 6:
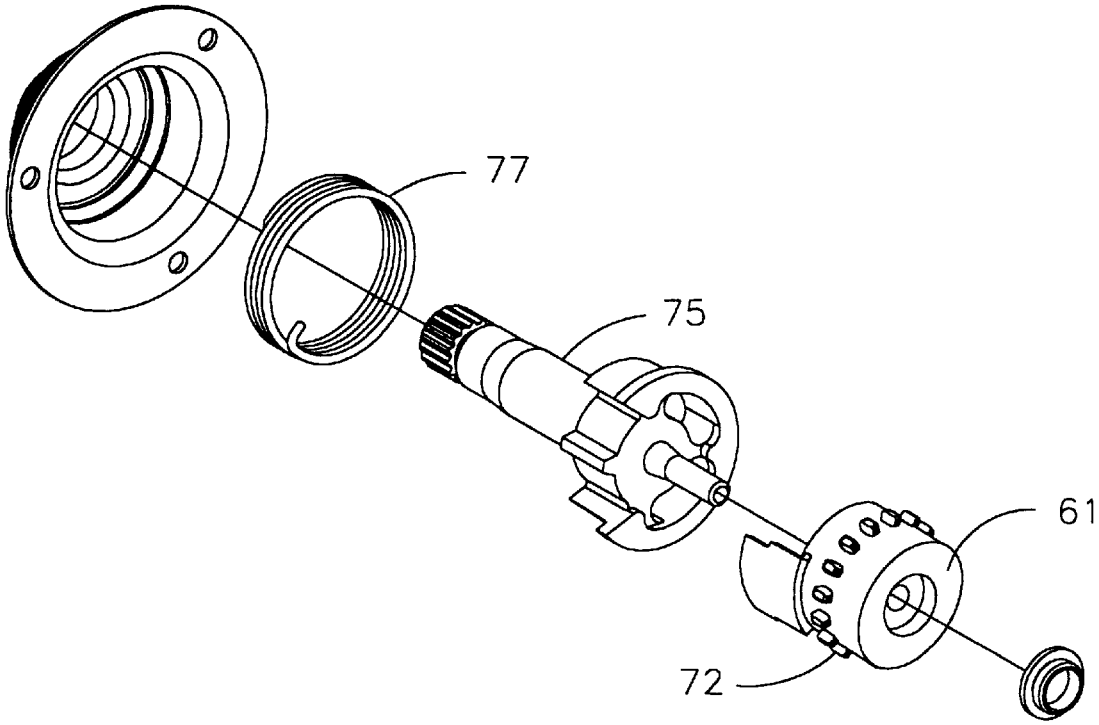
FIG. 6 is an exploded perspective view, partially broken away, of the drive member and drive drum for a manual window regulator in accordance with FIG. 1.
Figure 7:
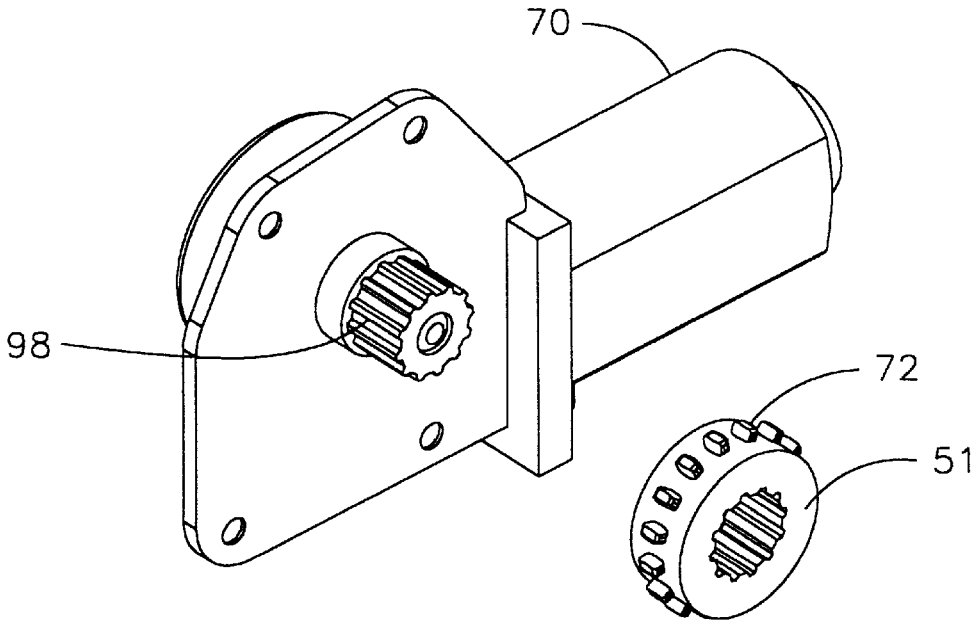
FIG. 7 is an exploded perspective view with some components removed for clarity of illustration of the drive member and drive drum for an electric window regulator in accordance with FIG. 4.

FIGS. 6 and 7 show exploded perspective views of the manual and electric drive mechanisms, respectively, for transmitting a force for moving the windowpane 11 up and down. The manual drive mechanism comprises a hand crank 78 (shown in FIG. 1) attached to a spindle 75, tensioned by a spring 77 mounted in a clutch cup 76. Rotation of the hand crank rotates the spindle 75 which in turn rotates manual drive drum 61. Drive drum 61 has circumferentially spaced teeth 72 which engage the tape 30 in corresponding tape drive slots 31. Thus, rotation of the hand crank in a first directions causes the tape drive to move in a first direction and rotation of the hand crank in a second direction causes the tape drive to move in a second direction opposite the first direction. In a similar fashion, electric motor 70 shown in FIG. 7 has an output member 98 connected to the electric drive drum 51 to provide a driving force to a pinion or other output member 98 which causes rotation of the electric drive drum 51 to rotate with teeth 72.

Note that in normal conditions the outside diameter of the manual drive drum 61 will be less than the outside diameter of the electric drive drum 51, but the teeth 72 on both drive drums will be sized the same so as the fit into the tape slots 31.

Figure 5:
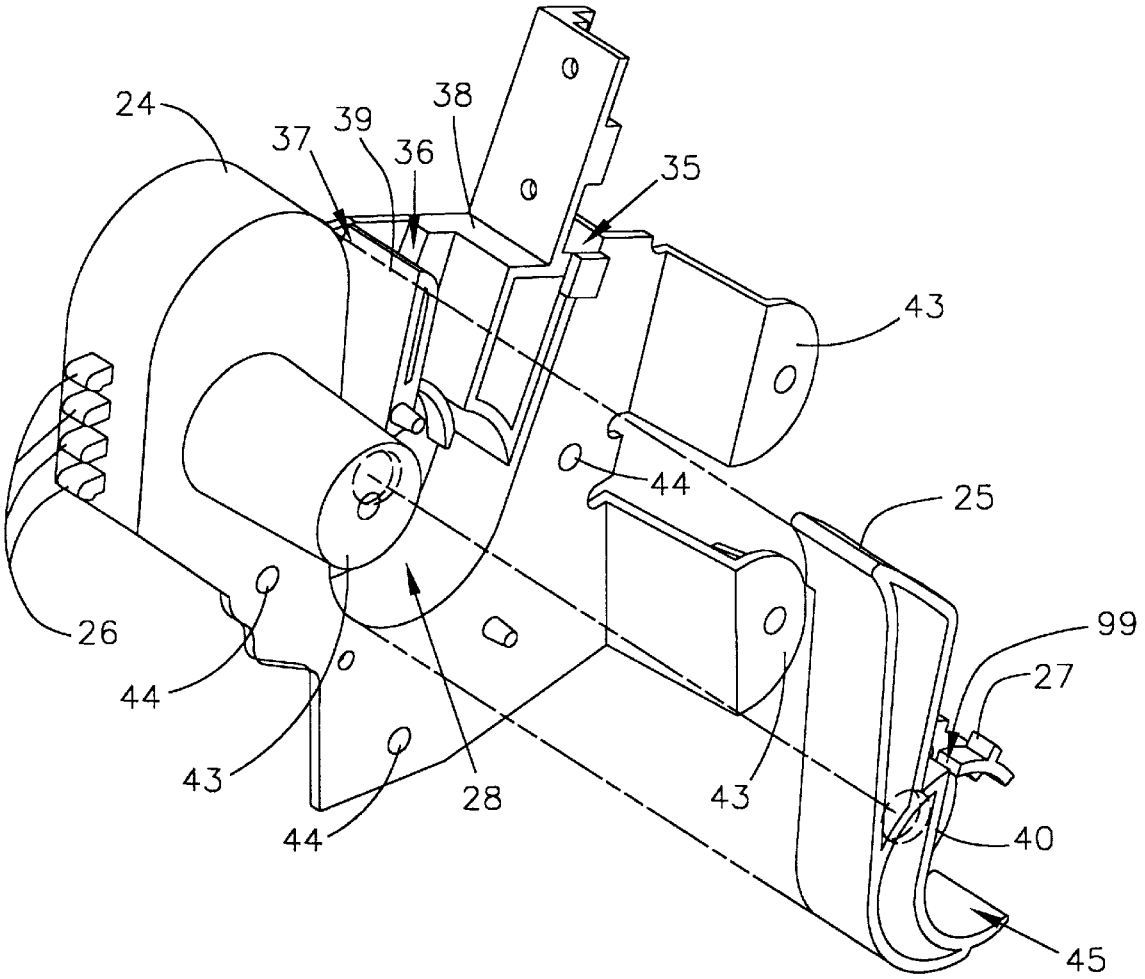
FIG. 5 is an isolated exploded perspective view showing the universal housing and the insert bracket for a manually driven embodiment of the window regulator.

FIG. 5 is a perspective view focusing on the universal housing 24 and the electric to manual insert bracket 25. The functions of the universal housing 24 include providing means for mounting the regulator assembly to the door, guiding means for the tape 30, and as a router to run the tape into the central channel 14 in rail 12. Universal housing 24 has mounting feet 43 for attachment to the motor vehicle door and also has openings 44 for attaching a motor 70 for electrically driven embodiments. First slot 35 routes the tape 30 into the rail 12, from a central cavity 28, where the tape is wrapped around either manual drive drum 61 (if the drive mechanism is a hand crank and spindle assembly), or electric drive drum 51 (if the drive mechanism is an electric motor).

As noted in the above, typically the outside diameter of the drive drum for each kind of regulator will be different due to the different applicable design constraints, and generally the electric drive drum diameter is greater than the manual drive drum diameter. In a highly advantageous feature, an insert bracket 25 is provided for use with a manual drive drum 61 and the central cavity 28 of the universal housing 24 is sized to receive the electric drive drum. First and second slots 35 and 36 are separated by separator 38, and second and third slots are separated by separator 39. The separator 39 and universal housing 24 are formed as one unitary component. The second and third slots 36, 37, depending on whether the drive mechanism is manual or electric, route the tape 30 to teeth 26 of the universal housing. One end of the tape is attached to the housing by teeth 26.

When the drive mechanism is manual, insert bracket 25 is inserted into the central cavity 28 and third slot 37. This forces the tape to be routed through second slot 36 from insert slot 99 of the insert bracket, aligned with the second slot 36. Insert bracket 25 has a pocket 45 for receiving the manual drive drum 61 and the tape 30, alignment tab 27, and opening 40 for the spindle. The insert bracket 25 advantageously accommodates the smaller diameter drive drum. Preferably either the insert bracket 25, the universal housing 24, or both are formed with sufficient flexibility that the insert bracket may be wedged into the central cavity 28 during assembly so that the bracket stays in the central cavity until final assembly to a panel of a motor vehicle door.

When the drive mechanism is an electric motor, the insert bracket need not be used, but advantageously the same universal housing 25 may be used as in the manual embodiment. In this case, the tape 30 is routed from the first slot 35, into the central cavity 28, around electric drive drum 51 and into third slot 37 to attachment teeth 26. Regardless of whether the electric design or the manual design is used, when the drive drum rotates in a clockwise direction (as viewed in FIGS. 1 and 4), a loop of tape (seen in FIGS. 1 and 4) forms between the drive drum and the teeth 26. When the drive drum rotates counterclockwise, the size of the loop of tape is reduced.

From the foregoing disclosure and detailed description of certain preferred embodiments, it will be apparent that various modifications, additions and other alternative embodiments are possible without departing from the true scope and spirit of the invention. For example, tape drive window regulators may also have additional routing mechanisms controlling the loop of tape that extends from the universal housing when the regulator is cycled toward the full up position. Additionally the universal housing and insert bracket may be used in other window regulator designs, such as cable drum window regulators. The embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A tape drive window regulator comprising, in combination:

a first rail defining a central channel;

an elongate flexible plastic tape having a plurality of holes therein, at least a first portion of the tape being positioned in the central channel;

drive means for moving the tape, the drive means comprising one of a manual hand crank connected to a spindle and an electric motor;

a drive drum rotatable by the drive means, said drive drum having circumferentially spaced teeth which engage the holes of the tape;

a universal housing operatively connecting the first rail and the drive means, the universal housing having a central cavity which receives the drive drum and a second portion of the tape, a first slot extending from the central channel into said central cavity, a third slot extending into the central cavity to route the tape from the drive drum out of the housing when the drive means comprises said electric motor, and a second slot extending into the central cavity to route the tape from the drive drum out of the housing when the drive means comprises said manual hand crank connected to said spindle, said second slot being positioned between said first slot and said third slot.

2. The window regulator of claim 1 further comprising a separator unitary with the universal housing separating the second slot from the third slot.

3. The window regulator of claim 2 wherein the electric motor includes an output member operatively connected to the drive drum, the drive drum being sized to cooperate with the electric motor when the drive means comprises said electric motor.

4. The window regulator of claim 2 wherein the spindle is operatively connected to the drive drum which is sized to cooperate with the spindle when the drive means comprises said manual hand crank connected to said spindle.

5. The window regulator of claim 4 further comprising an insert bracket having a first portion positioned in the central cavity and a second portion positioned in the third slot.

6. The window regulator of claim 5 wherein the insert bracket has an insert slot aligned with the second slot and the tape is routed through the insert slot to the second slot.

7. The window regulator of claim 1 further comprising a second rail having a second central channel which receives the tape, the second rail being connected to the first rail by an apex bracket.

8. The window regulator of claim 7 further comprising a glider slidably attached to the second rail, the glider having teeth which engage corresponding said holes in the tape, and an engagement flange extending from one side of the glider.

9. The window regulator of claim 8 further comprising:

a windowpane having a bottom edge, the windowpane being movable between a full up position and a full down position by operation of the drive means; and a windowpane attachment bracket attached to the bottom edge of the windowpane and including an engagement slot;

wherein the engagement flange is positioned at least partially in the engagement slot, securing the glider to the attachment bracket.

10. The window regulator of claim 9 wherein the engagement flange is aligned generally parallel with the bottom edge of the windowpane.

* * * * *